United States Patent [19]

Hansen

[11] 4,337,600

[45] Jul. 6, 1982

[54] HELICAL STORAGE BIN

[76] Inventor: Elmer K. Hansen, 801 S. Martha St., Sioux City, Iowa 51106

[21] Appl. No.: 139,574

[22] Filed: Apr. 11, 1980

[51] Int. Cl.[3] ..... E04B 7/00; E04B 1/32

[52] U.S. Cl. ..... 52/82; 52/247

[58] Field of Search ..... 52/528, 745, 747, 192, 52/246, 247, 248, 249, 82; 220/1 B, 5 A; 29/773, 429; 228/145, 184; 119/52

[56] References Cited

U.S. PATENT DOCUMENTS

| | | | |
|---|---|---|---|
| 1,869,224 | 7/1932 | Scarritt | 228/145 |
| 1,906,010 | 4/1933 | Naylor | 228/145 |
| 2,691,959 | 10/1954 | Dueringer | 52/247 |
| 3,171,517 | 3/1965 | Howell | 52/247 |
| 3,365,855 | 1/1968 | Vermette | 29/429 |
| 3,694,892 | 10/1972 | Hale | 29/429 |
| 4,197,689 | 4/1980 | DeMuth | 52/745 |

FOREIGN PATENT DOCUMENTS

| | | | |
|---|---|---|---|
| 1162976 | 2/1964 | Fed. Rep. of Germany | 52/82 |

*Primary Examiner*—John E. Murtagh
*Attorney, Agent, or Firm*—Rudolph L. Lowell

[57] ABSTRACT

The cylindrical shaped helically wound storage bin is comprised of a roof unit and a side wall structure each of which is separately formed and assembled together in the field. The wall structure and the roof unit are each formed from a continuous metal ribbon member. The ribbon member of the roof unit is helically wound and continuously interlocked in a stepped dome shape with the interlocking connection of the adjacent sides of the metal ribbon constituting riser portions of the steps and a reinforcing member for the roof unit. The metal ribbon of the bin wall structure is helically wound and continuously interlocked along the adjacent sides thereof in a cylindrical shape with the interlocking connection forming a continuous rigid reinforcing rib that projects outwardly from and extends spirally about and over the full height of the side wall structure. The lower end of the wall structure is mounted on a lower helical coupling section that is secured to a base or foundation to support the wall structure about a substantially vertical axis. The upper end of the wall structure and the outer peripheral section of the roof unit are relatively formed and interconnected by an upper helical coupling section to provide for the horizontal support of the roof unit on the wall structure.

1 Claim, 19 Drawing Figures

FIG. 3
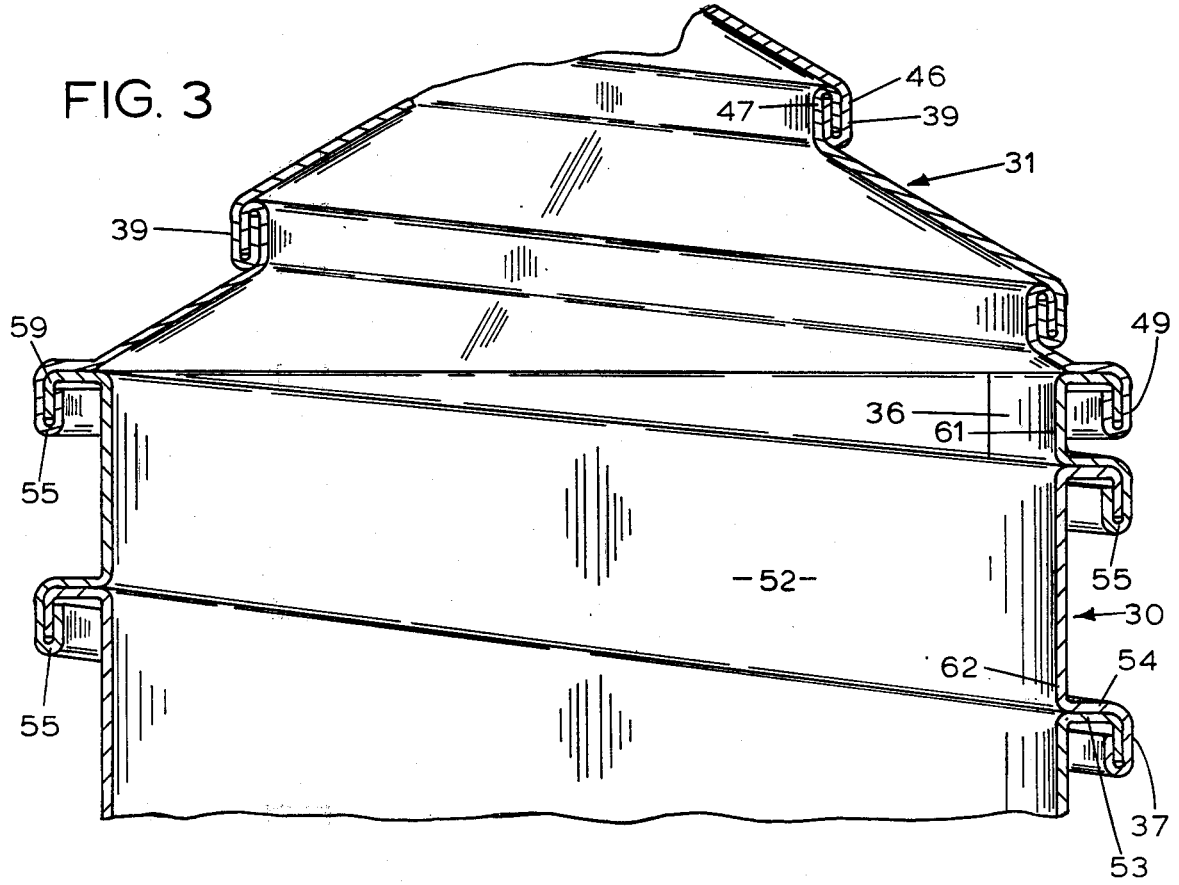
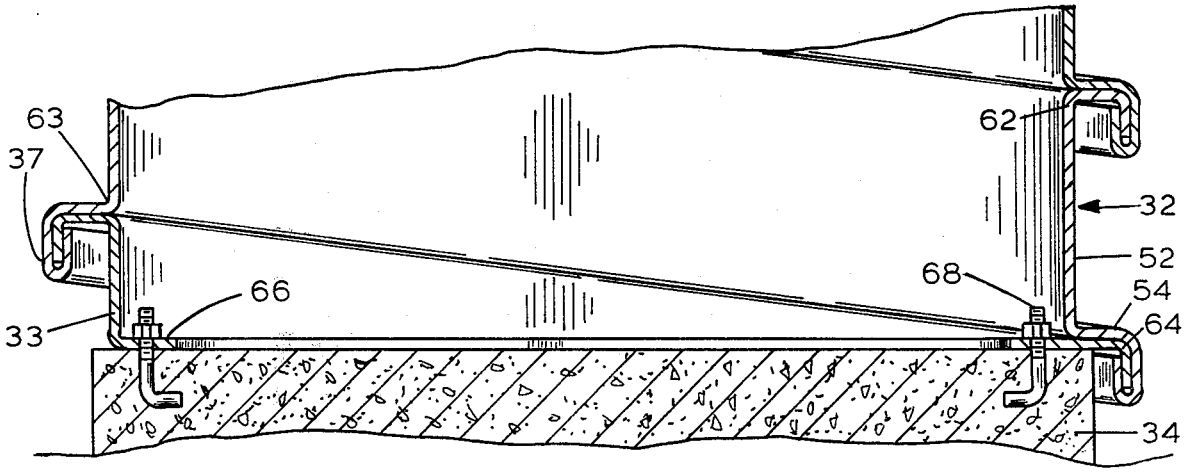
FIG. 4

HELICAL STORAGE BIN

BACKGROUND OF THE INVENTION

Metal storage bins and the like are generally of a factory prefabricated construction with the parts thereof shipped for assembly in the field. Usually, erection of the bin side wall structure requires special personnel and equipment and separate fastenings for securing the prefabricated sections together. As a result, this type of bin is relatively expensive to manufacture and transport and requires appreciable time in the field for installation or erection.

Thus, U.S. Pat. No. 2,751,672 discloses a storage bin having a sidewall structure comprised of a series of helical or spiral strips that are factory prefabricated and specially designed for strength to withstand a working stress at a particular height location on the side wall. Although the storage bin is erected in the field, the prefabricated parts must be assembled in a predetermined overlapping pattern by special erecting equipment and with the parts then being connected together by separately provided bolt means, after which the connecting joints are calked or sealed. The roof unit is also prefabricated for erection in the field and is assembled as a unit with the wall structure.

The disclosure of U.S. Pat. No. 4,067,097 is also directed to a cylindrical bin formed of factory fabricated helical units assembled in the field and secured together by weldments.

In U.S. Pat. No. 3,380,147, the side wall structure is of a cylindrical shape and erected in the field by passing a roll of sheet steel through a set of crimping rollers to slightly curve the sheet along with off-setting the upper edge of the sheet so that a leading section of the sheet will receive the lower edge of an adjacent trailing section of the sheet as the sheet is being helically wound. These adjacent edges are initially spot welded against separation and then finally secured by a continuous weld. Preformed strips of the sheet roll are secured at the top and bottom of the side wall structure to provide horizontal end surfaces for mounting of the roof unit on the upper end of the side wall, and for the support of the bottom end of the side wall on a foundation. Upright beam members, that are circumferentially spaced about and welded to the side wall structure after it has been helically wound, assist in the lowering of the erected wall structure onto the foundation therefor. Additionally, these beam members remain secured to the side wall and function as reinforcing members for resisting side wall expansion.

SUMMARY OF THE INVENTION

The storage bin is economical in cost and of a rugged and simple construction for easy erection in the field, in a relatively short period of time. Shipping costs of the bin are appreciably reduced by the transportation of the roof unit and side wall structure to the erection sight as a roll or reel of sheet metal which alone provide all of the parts required for its erection. By forming the ribbon or sheet metal material for continuous interlocking engagement of the adjacent sides thereof as it is being helically wound to form the stepped dome shaped roof unit and the cylindrical side wall structure, the use of separate connecting bolts, plates or like means are completely eliminated. The interlocking connection of the adjacent ribbon sides provides annular flange sections projected outwardly from the wall structure and terminating in a vertical rim that defines a continuous reinforceing member extended helically about and over the full height of the side wall structure. The side wall structure is thus rigid, self-supporting, and braced against expansion stresses. By virtue of the location of the interlocking connection exteriorly of the wall structure, the inner peripheral surface thereof is substantially smooth and free of any obstructions or irregularities that might interfere with a free downward flow or movement of material stored in the bin. The interlocking engagement of the adjacent ribbon sides in the roof unit provides a vertically extended connection that defines a continuous helically extended riser section between adjacent ribbon sections that constitutes a rigid brace for the roof unit. Labor and material costs are thus appreciably reduced without impairing the capability of the bin to withstand rugged use and working expansion pressures over a long service life with a minimum of maintenance.

DESCRIPTION OF THE DRAWINGS

FIG. 3 is an enlarged transversely foreshortened sectional detail view of the upper portion of the bin taken on line 3—3 in FIG. 1, showing the assembly of the roof unit with the side wall structure;

FIG. 4 is an enlarged transversely foreshortened sectional detail view of the lower portion of the bin showing the assembly of the side wall structure with a base member for the bin; as seen along line 4—4 in FIG. 1;

DESCRIPTION OF THE INVENTION

Figure 1:
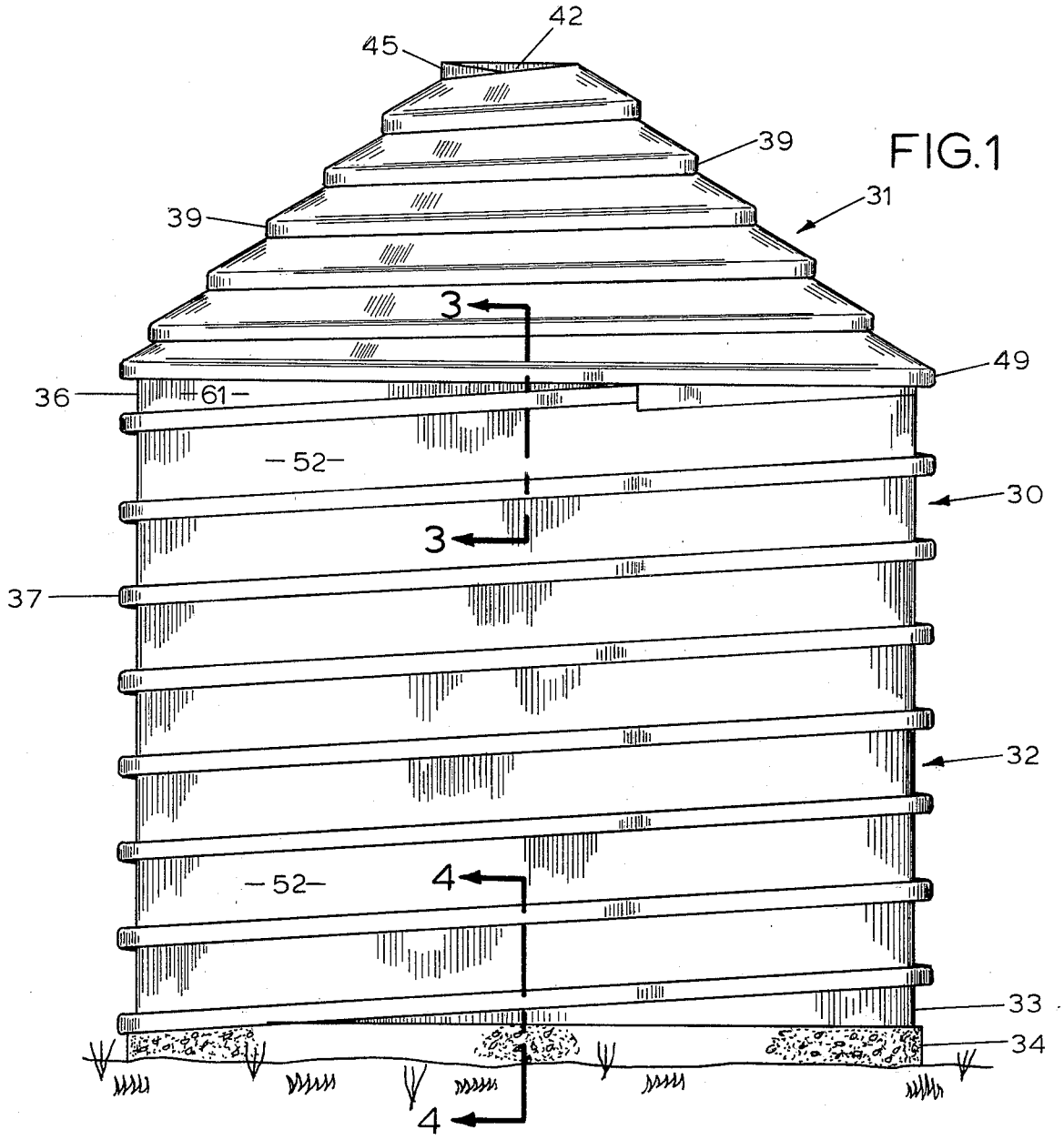
FIG. 1 is a side elevational view of the storage bin of this invention.

With reference to FIGS. 1, 3 and 4 of the drawings, the helically wound bin, indicated generally as 30, is of a cylindrical shape and includes a one piece helically wound roof unit 31 and a one piece cylindrically shaped helically wound wall structure 32, the botton end of which is in interlocked connection with a bottom full circle helical section 33 connected to and supported on a foundation member 34 for support of the wall structure in an upright vertical position. An upper full circle helical section 36 is of a construction adapted for interlocking engagement with the outer periphery of the roof unit 31 and top of the structure 32 and is of a shape to horizontally support the roof unit on the wall structure.

The bin wall structure 32 is erected in the field and is formed from a roll of sheet metal ribbon material (not shown) that, in the erection of the wall structure, is progressively passed through a series of forming rollers (not shown) to curve the ribbon member and shape the opposite side edges thereof prior to the helical winding of the ribbon member into an upright cylindrical shape. In the winding of the wall ribbon member, the adjacent side edges thereof are continuously interlocked in a connection that forms a reinforcing rib or strap 37 extended helically about the exterior surface of the wall structure over the full height thereof. The wall structure 32 is thus self supported and reinforced to withstand any expansion pressures that may be effected by material stored within the bin 30.

The roof 31 is also formed from a roll of sheet metal ribbon material (not shown) and is helically wound into a stepped dome shape with the adjacent side edges of the roof metal ribbon being continuously interlocked such that the helically extended interlocking connection forms a continuous riser 39 that extends helically over the upper surface of the roof unit 31. The vertically extended riser 39 functions as a continuous brace member providing for the self support of the roof unit.

In the erection of the bin 30, the roof unit 31 is initially constructed separately from the wall structure 32 and is then assembled with the upper helical section 36. The metal ribbon member for the wall structure 32 is then preshaped and helically wound into interlocking engagement with the lower side of the upper helical section 36 after which the metal ribbon is fed upwardly into the cylindrical shaped side wall 32 with the roof unit 31 carried thereon as the height of the wall structure is progressively increased. The diameters of the wall structure 32 and roof unit 31 are of a predetermined side which may be set by the adjustment of the forming rollers therefor to curve the ribbon member in a helix in accordance with the predetermined diameters.

Figure 2:
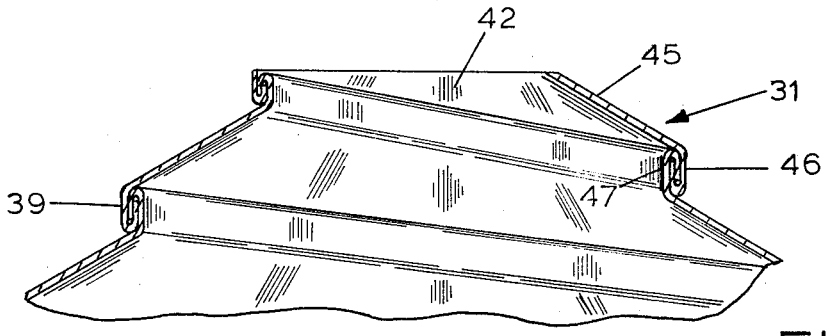
FIG. 2 is a fragmentary enlarged sectional view on line 2—2 in FIG. 5.

After the wall structure 32 has been erected to the desired height, its lower end is interlocked with the bottom full circle helical section 33 and the completed bin 30 is then lowered onto and secured to the concrete base of foundation member 34 which was prepared prior to the erection of the bin. Access to the interior of the bin may be made through the central opening 42 in the roof unit 31 or through suitable openings (not shown) that may be formed in the side wall structure 32. (FIGS. 1 and 2).

Figure 12:
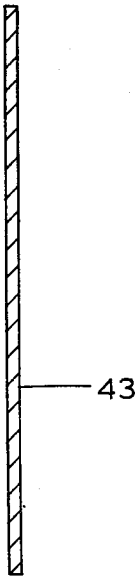
FIG. 12 is a transverse cross sectional view of the metal ribbon used in the construction of the roof unit prior to the forming of the ribbon in the field.
Figure 13:
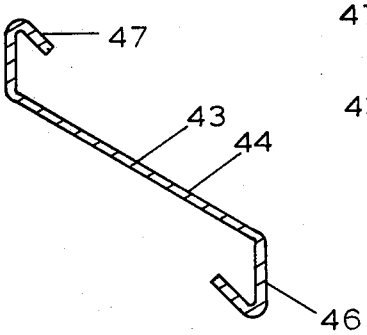
FIG. 13 shows the shape of the metal ribbon of FIG. 12 prior to the helical winding of the ribbon into a stepped dome shape.
Figure 14:
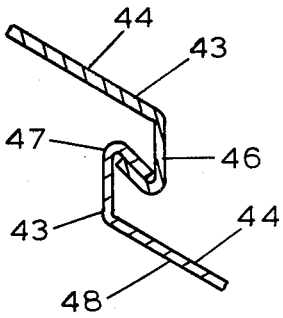
FIG. 14 shows the initial relative positions of adjacent sides of the metal ribbon in the helical winding of the roof unit.
Figure 15:
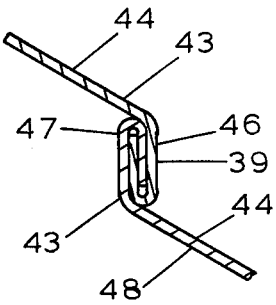
FIG. 15 shows the interlocking of the adjacent sides of the metal ribbon for the roof unit after such sides have been relatively arranged as shown in FIG. 14.

In the constructin of the roof unit 31, the sheet metal ribbon member 43 (FIG. 12) is progressively passed through forming rollers (not shown) and shaped with a central section 44 and end sections formed into open hooks 46 and 47 (FIG. 13), which open to opposite sides of the central section 44. The roof ribbon member 43, with the transverse sectional shape of FIG. 13 is then helically wound in a downward and outward direction concurrently with progressively varying the curvature laterally thereof to assume the stepped dome shape of the roof unit 31. On the completion of the full circle helix 45 which defines the side wall of the central opening 42 in the roof unit 31, the lower side or hook 46 thereof is in a position (FIG. 14) to receive in an overlapping relation the upper side or hook 47 of the incoming section 48 of the ribbon member 43. The hook 46 at the lower side of the full circle helix 45 and the hook 47 at the upper side of the incoming section 48 of the metal ribbon are then closed into each other (FIG. 15) so that the upper side of a latter incoming section of the metal ribbon is movable into position for interlocked engagement with the lower side of the prior incoming section 48.

Figure 5:
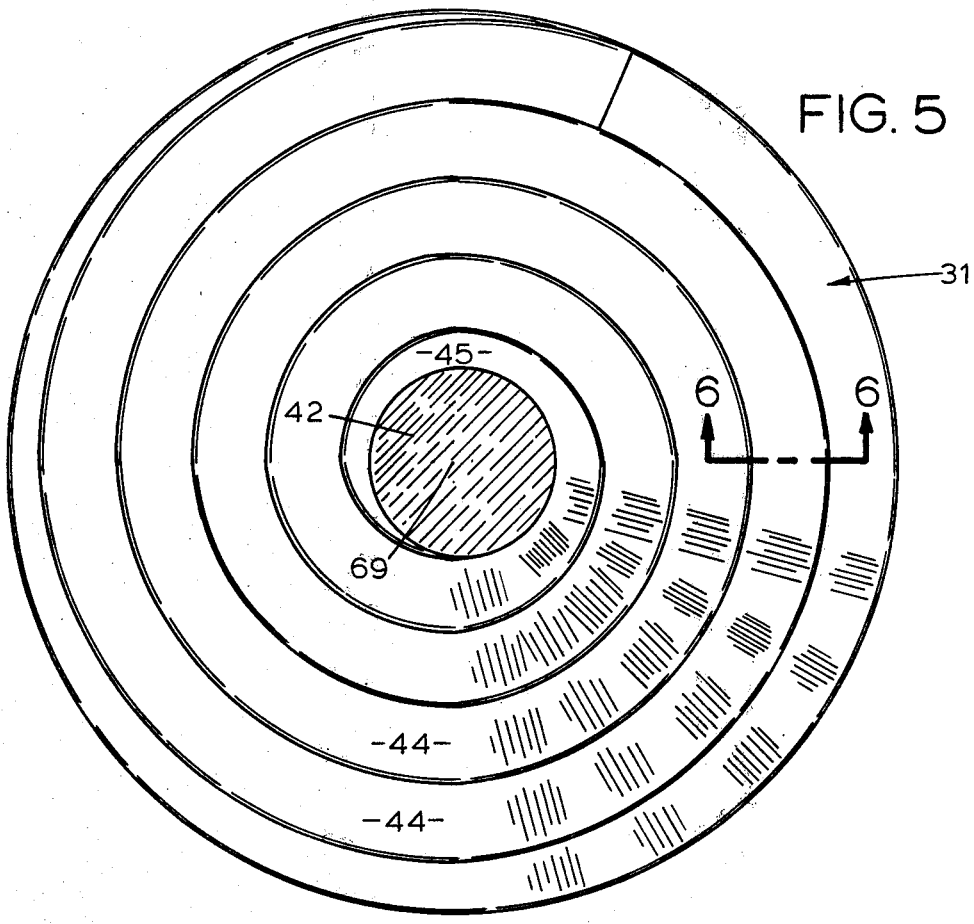
FIG. 5 is a top plan view of the bin shown in FIG. 1.
Figure 6:
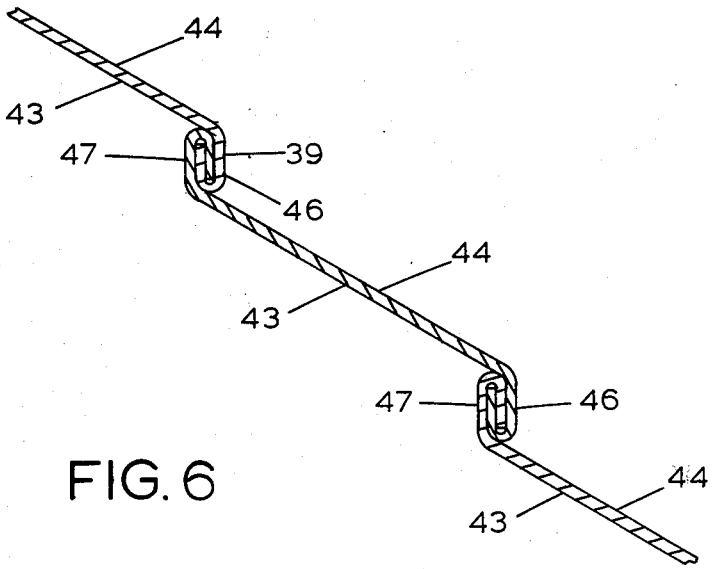
FIG. 6 is an enlarged sectional detail view taken on the line 6—6 of FIG. 5.
Figure 16:
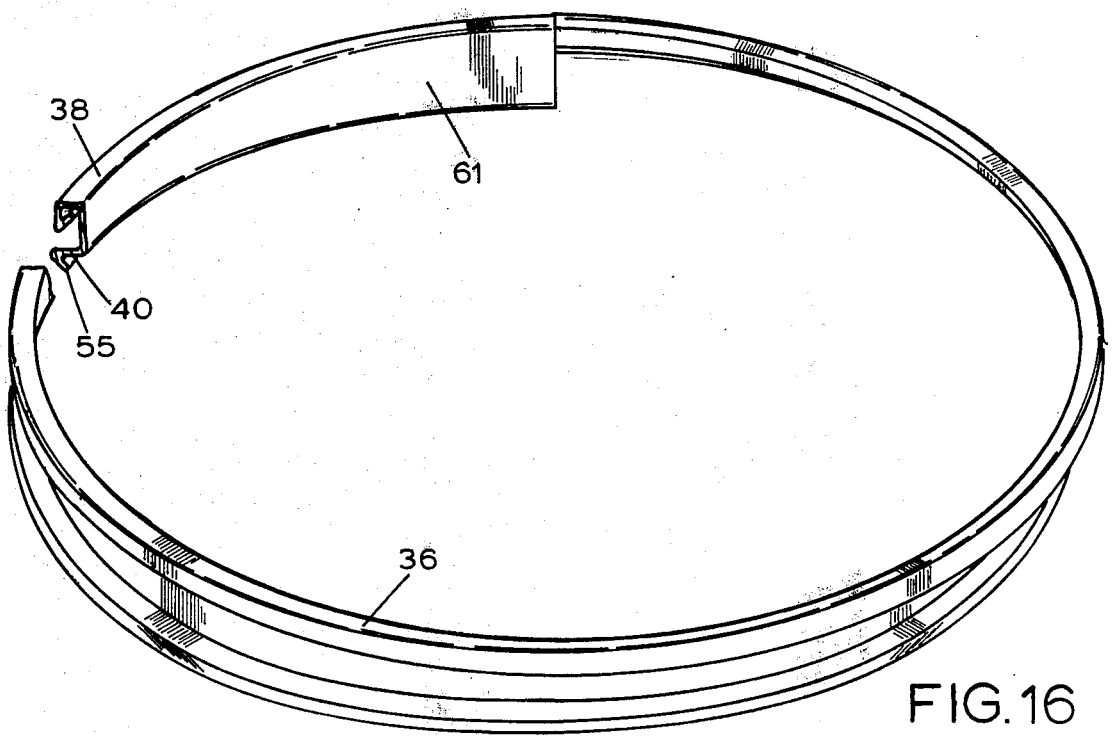
FIG. 16 is a perspective view of the top full circle helical section of the bin wall structure that is formed in the field to support the roof unit in a horizontal position.

Thus, as seen in FIGS. 5 and 6, the roof unit 31 is helically wound about the central opening 42 with the central section 44 of the metal ribbon 43 inclined downwardly and outwardly from such opening in a progressively increasing helix with the interlocked hook shaped sides 46 and 47 of adjacent sections of the ribbon member 43 extended vertically to form the riser 39 which rigidly connects together all of the helical sections to provide a self supported roof unit. When the roof has been helically wound to a predetermined diameter, corresponding to the diameter of the wall structure 32 on which it is to be carried, the lowermost or outer peripheral section of the roof, indicated at 49 (FIGS. 1 and 3), is then trimmed and formed in conformance with and for mating interlocking engagement with the upper helical section 36. The helical section 36 (FIG. 16) is formed separately from the roof unit 31 and the side wall structure 32 and is of a construction to support the roof unit in a horizontally disposed position on the wall structure and to set or predetermine the angle of inclination for the helical winding of the sheet metal ribbon member of the side wall. The upper side 38 of the upper helical section 36, therefore, is formed for interlocking engagement with the lower side of the peripheral section 49 of the roof unit 31 and the lower side 40 of the helical section 36 is formed for interlocking engagement with the upper end of the wall structure (FIG. 4).

Figure 7:
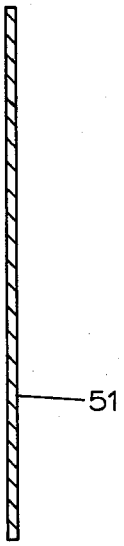
FIG. 7 is a cross sectional view of the flat metal ribbon used in the construction of the side wall structure.
Figure 8:
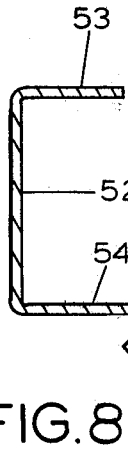
FIG. 8 shows the cross sectional shape of the metal ribbon when it is to be wound into the helical cylindrical shape.
Figure 9:
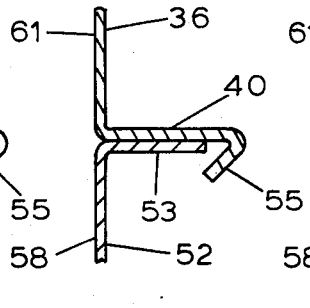
FIG. 9 is a detail sectional view showing terminal portions of the adjacent sides of the metal ribbon in their initial relative positions when the metal ribbon is being helically wound into a cylindrical shape.
Figure 10:
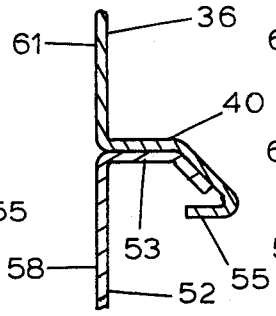
FIGS. 10 and 11 show the progressive forming steps for interlocking the adjacent sides of the metal ribbon after the sides have been initially helically wound into their relative positions of FIG. 9.
Figure 11:
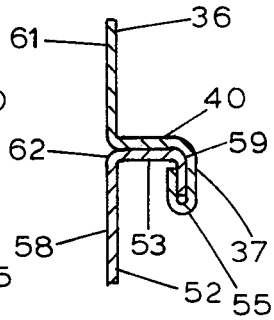

The roof unit 31 with the upper helical section 36 connected thereto is supported on equipment (not shown) providing for the metal ribbon material of the wall structure, during the helical winding thereof, being fed upwardly so that when the wall structure 32 is erected, the roof unit will already be in place thereon. The metal ribbon material for the wall structure 32, indicatd at 51, is initially of a flat shape in transverse cross section (FIG. 7) and is progressively shaped by forming rollers (not shown) into the substantially channel shape illustrated in FIG. 8 having a base or web 52, a short leg 53 and a long leg 54 terminating in a hook 55. The ribbon member 51 is then helically wound in an upward direction for interlocking engagement with the upper helical section 36. In this respect, it is to be noted that the lower side 40 of the helical section 36 (FIG. 16) will initially be of the same shape as the leg 54 in FIG. 8 to provide for the engagement thereof with the leg 53 at the upper side of the leading section 58 of the ribbon member 51 (FIG. 9). Following this initial engagement, the leg 53 and lower side 40 of the helical section 36 are initially bent together (FIG. 10) to direct the leg 53 into the hook 55 on the lower side of the helical section 36. Following this initial relative arrangement, the legs 53 and 54 are finally shaped to form a male hook 59 for interlocking engagement with the female hook 55, as shown in FIGS. 3 and 11.

Following the interlocking connection of the upper helical section 36 with the leading section 58 of the metal ribbon 51, the ribbon 51 is helically wound upwardly for successive initial positioning and then interlocking engagement of the adjacent sides or legs 53 and 54 thereof in the manner above described for the upper side of the ribbon leading section 58 and lower side 40 of the helical section 36.

It is seen, therefore, that the center portion 61 of the upper helical section and the center or web section 52 of the helically wound metal ribbon 51 (FIGS. 3 and 11) are vertically extended in circumferential alignment to form the wall member 62 of the wall structure 32 and that adjacent leg sections 53 and 54 initially extend laterally in abutting engagement outwardly from such wall member 62 with the interlocked hook portions 55 and 59 thereof vertically extended in a concentrically spaced relation with the center sections 52 and 61.

The interlocking connection or coupling of adjacent sides of the metal ribbon 51 provides a wall structure 32 that has a wall member 62 with an inner surface free of any obstructions or irregularities that would interfere with a free downward movement of material stored in the bin 30. Importantly, the continuous interlocking connection of the adjacent sides of the helically wound metal ribbon 51, with the interlocked hook portions 55 and 59 vertically extended, positively eliminates any relative lateral movement between adjacent helices that may result from expansion pressures within the bin. Since this interlocking connection extends helically about the bin and over the full height thereof, it forms the rigid brace member 37 for the self support of the wall structure 32 and the elimination of any separate connecting means or braces for such purpose.

Figure 17:
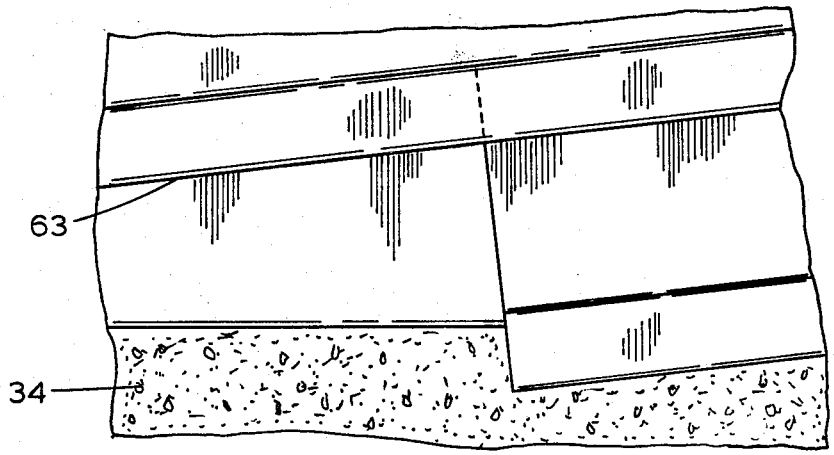
FIG. 17 is a detail fragmentary enlarged elevational view showing the assembly of full circle bottom helical section formed in the field and assembled with the bottom of the side wall structure for support on a foundation mounting therefor.
Figure 18:
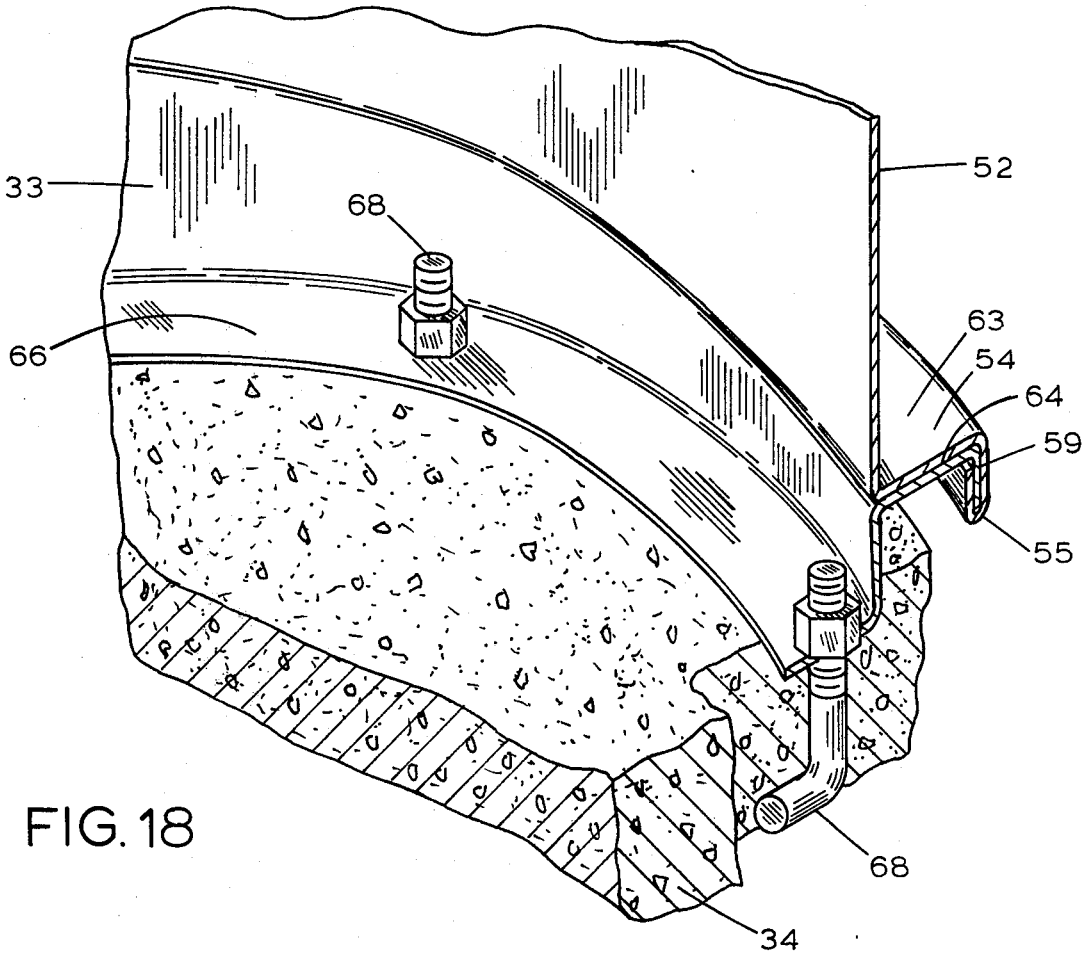
FIG. 18 is an enlarged detailed perspective view showing the assembly of the bottom helical section with a foundation member for the bin.
Figure 19:
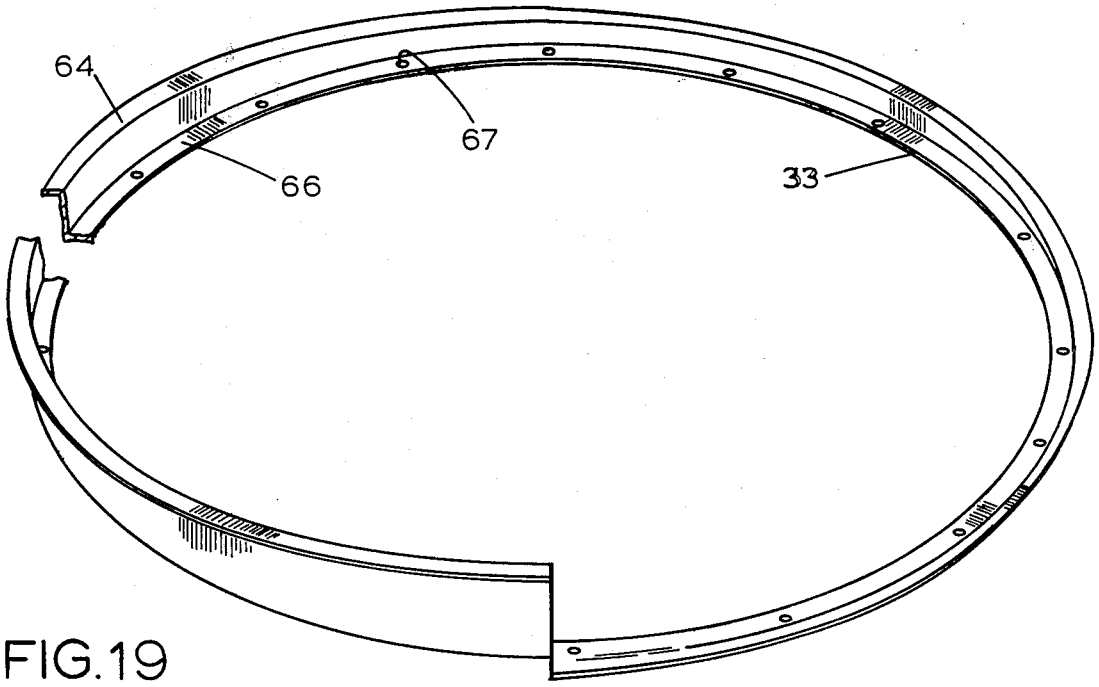
FIG. 19 is a perspective view of the bottom full circle helical section.

When the wall structure 32 has been erected to a desired height, the bottom side 63 thereof (FIGS. 4, 17 and 18) is interlocked with the upper side 64 of the bottom helical section 33 (FIG. 19) by which the wall structure 32 is connected to and vertically extended from the base or foundation member 34. For this purpose, the helical section 33 has an inwardly extended annular flange 66 for resting engagement on the outer peripheral surface of the foundation 34, which is of a circular shape and of a diameter substantially equal to the diameter of the wall structure 32 so that a portion of the interlocking connection of the wall structure with the helical section 33 overhangs the foundation 34, as illustrated in FIGS. 4 and 17. The flange 66 (FIG. 19) is formed with a series of circumferentially spaced openings 67 for receiving associated foundation bolts 68 (FIG. 18).

With the bottom helical section 33 interlocked with the lower end of the wall structure 32, the bin 30 as a unit assembly is lowered by the erection equipment (not shown) into place on the foundation 34 for attachment thereto. Any erection equipment within the bin is then dismantled for removal through the central opening 42, or through openings (not shown) that may be formed in the side wall structure 32. It will be noted (FIG. 5) that the roof opening 42 is laterally offset from the vertical axis of the bin, indicated at 69, as a result of the helical winding of the metal ribbon 43. However, this off center position of the opening 42 does not interfere in any way with the function of the bin for storage or grain drying purposes, and it may be closed by a suitable circular cover (not shown).

It is seen, therefore, that the bin 30 is formed of a roof unit 31, side wall structure 32 and connecting helical sections 33 and 36. The roof unit is helically wound from a single roll of a flat metal ribbon material having adjacent sides thereof continuously interlocked to provide a self-supported structure. In a like manner, the side wall structure 32 is erected from a single roll of a metal ribbon material by being helically wound into a cylindrical shape concurrently with interlocking adjacent sides of the metal ribbon to provide a rigid brace member extended helically about the wall structure over the full height thereof.

Although the invention has been described with respect to a preferred embodiment thereof, it is to be understood that it is not to be so limited since changes and modifications can be made therein which are within the full intended scope of this invention as defined by the appended claims.

I claim:

1. A cylindrical storage bin comprising:

(a) a one piece upright side wall structure formed of a continuous metal ribbon member wound in a closed helical cylindrical shape, and having an upper end and a lower end, (b) coacting locking means formed on the opposite sides of said ribbon member to continuously and rigidly interlock adjacent sides of the ribbon member in said closed cylindrical shape, (c) a roof unit for the upper end of said wall structure having an outer peripheral portion, (d) means for securing said outer peripheral portion to the upper end of the side wall structure, means for supporting the lower end of the side wall structure on a foundation with the axis of the wall structure extended substantially vertically, (f) said wall structure including a vertically continuous wall member, (g) said coacting locking means, at the junction of adjacent sides of said ribbon member, including a pair of annular horizontal flange sections projected in a superposed relation laterally outwardly from the wall member, with one of said flange sections terminating in a female locking hook and the other of said flange sections in a male locking hook, said locking hooks extended vertically of said wall member whereby said coacting locking means forms a continuous reinforcing rib exteriorly of and about the wall member over the full height thereof, (h) said roof unit formed of a continuous metal ribbon member wound in a closed helical stepped dome shape, and (i) coacting locking means formed on opposite sides of said roof ribbon member to continuously and rigidly interlock the adjacent sides of the roof ribbon member in the helical dome shape thereof, (j) said locking means in interlocked engagement being extended vertically at the junction of adjacent sides of said roof ribbon member to form a riser section in said stepped dome shape roof unit that constitutes a continuous integral support for the roof unit.

* * * * *